US006601779B1

(12) United States Patent
Heren et al.

(10) Patent No.: US 6,601,779 B1
(45) Date of Patent: Aug. 5, 2003

(54) SPRINKLER BEARING ASSEMBLY

(75) Inventors: Lawrence P. Heren, East Peoria, IL (US); Scott Jacobs, Bloomington, IL (US)

(73) Assignee: L. R. Nelson, Peoria, IL (US)

( * ) Notice: Subject to any disclaimer, the term of this patent is extended or adjusted under 35 U.S.C. 154(b) by 0 days.

(21) Appl. No.: 09/876,241

(22) Filed: Jun. 6, 2001

(51) Int. Cl.[7] ..... B05B 3/06; B05B 3/00

(52) U.S. Cl. ..... 239/251; 239/225.1; 239/261; 239/263; 239/264; 239/279; 239/280

(58) Field of Search ..... 239/225.1, 251, 239/261, 263, 264, 279, 280, 587.1

(56) References Cited

U.S. PATENT DOCUMENTS 1,564,934 A * 12/1925 Buelna et al.
2,335,332 A * 11/1943 Wright
2,619,384 A * 11/1952 Jepson
2,625,411 A * 1/1953 Unger
2,980,341 A * 4/1961 Royer et al.
3,799,631 A * 3/1974 Martina ..... 239/230
3,957,205 A * 5/1976 Costa ..... 239/230
5,901,906 A * 5/1999 Bouldin ..... 134/167 R

* cited by examiner

*Primary Examiner*—Robin O. Evans
(74) *Attorney, Agent, or Firm*—Mayer, Brown, Rowe & Maw

(57) ABSTRACT

A rotating bearing assembly for a sprinkler coupled to a pipe segment is disclosed. The bearing assembly has a stem which permits fluid flow. The stem has a bottom open end with a collar and a top open end which is connected to a cap. The cap allows connection to a sprinkler head which rotates from water pressure through the pipe segment. The stem conduit rotates in relation to a sleeve which is frictionally fitted within the pipe segment. A plurality of washers is located between the collar and the bottom of the sleeve to provide a water seal under high pressure conditions. Another group of washers is located between the top of the sleeve and the cap to provide additional sealing under low pressure conditions.

19 Claims, 6 Drawing Sheets

SPRINKLER BEARING ASSEMBLY

FIELD OF INVENTION

This invention relates to a bearing for a rotating sprinkler and more specifically for a bearing assembly which joins a sprinkler head to a pipe allowing for rotation of the sprinkler head.

BACKGROUND OF INVENTION

Common sprinklers often involve rotating spray heads in order to maximize the distribution of water. Such sprinklers have a connector to a water source and a bearing which allows rotation of the spray heads. The sprinklers may be spiked to the ground or they may be supplied with a base which permits a user to place the sprinkler in a desired location.

Another common irrigation system uses a network of pipes connected to sprinkler heads which are installed on vertical pipes which are dispersed to irrigate a certain area. The sprinkler heads are installed on vertical pipes and are capped by a nozzle head which allows water to be forced out of the nozzle head, under pressure, in various spray patterns. The nozzle head design determines the spray pattern from the sprinkler head. In order to maximize the area which is covered by each of the sprinkler heads, the sprinkler heads are designed to rotate thus throwing water over a circular area. Also, in order to prevent the collection of fluid at a particular locale, it is highly desirable for the sprinkler heads to evenly distribute the water over the entire area to be irrigated. The rotation of such heads is accomplished by the pressurized water which provides the movement of the nozzle head by means of a series of internal vanes or orifice or outer body. A rotating bearing attaches the nozzle heads to the pipe.

Heretofore, prior art sprinkler bearings for both mobile and fixed sprinklers were ineffective because they could not create a water tight seal between the sprinkler and the pipe while insuring a low friction coupling of the head to the body and minimizing wear on the joint. Such known bearings may be water proofed but this requires additional materials and parts thus increasing the cost.

Thus there exists a need for a rotating sprinkler bearing which provides a water tight seal between the sprinkler and the supply pipe while insuring low friction coupling. There is a further need for a bearing for a sprinkler head which facilitates the even distribution of water by the sprinkler head at low and high pressure ranges. There is also a need to provide a sprinkler bearing assembly which is simple and inexpensive to manufacture and assemble.

SUMMARY OF THE INVENTION

These needs may be met through the present invention which is embodied in a bearing assembly for rotatably supporting a fluidly connected outlet member from a pipe segment. The bearing assembly has a hollow, generally cylindrical stem extending along a longitudinal axis which defines a fluid conduit chamber. The stem has an inlet end with an annular collar and an outlet end. A cap is connected to the outlet end. The cap has an fluid inlet and an outlet with a connector connectable to the outlet member. A sleeve is provided having an open top end and a bottom end annularly located around the fluid conduit. The sleeve is in frictional contact with the interior of the pipe segment, where the cap and the stem rotate relative to the sleeve.

The invention may also be embodied in a bearing assembly for rotatably coupling a sprinkler head to a pipe segment. The bearing assembly has a hollow, generally cylindrical stem extending along a longitudinal axis and defines a fluid conduit chamber. The stem has an inlet end with an annular collar and an outlet end. A cap is connected to the outlet end. The cap has an fluid inlet and an outlet with a connector connectable to the sprinkler head. A sleeve having an open top end and a bottom end is annularly located around the fluid conduit. The sleeve is in frictional contact with the interior of the pipe segment, where the cap and the stem rotate relative to the sleeve. A low pressure sealing washer is seated around the stem between the top of the sleeve and the cap. A high pressure sealing washer is seated around the stem between the bottom of the sleeve and the collar of the stem.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DESCRIPTION OF THE PREFERRED EMBODIMENT

Figure 1:
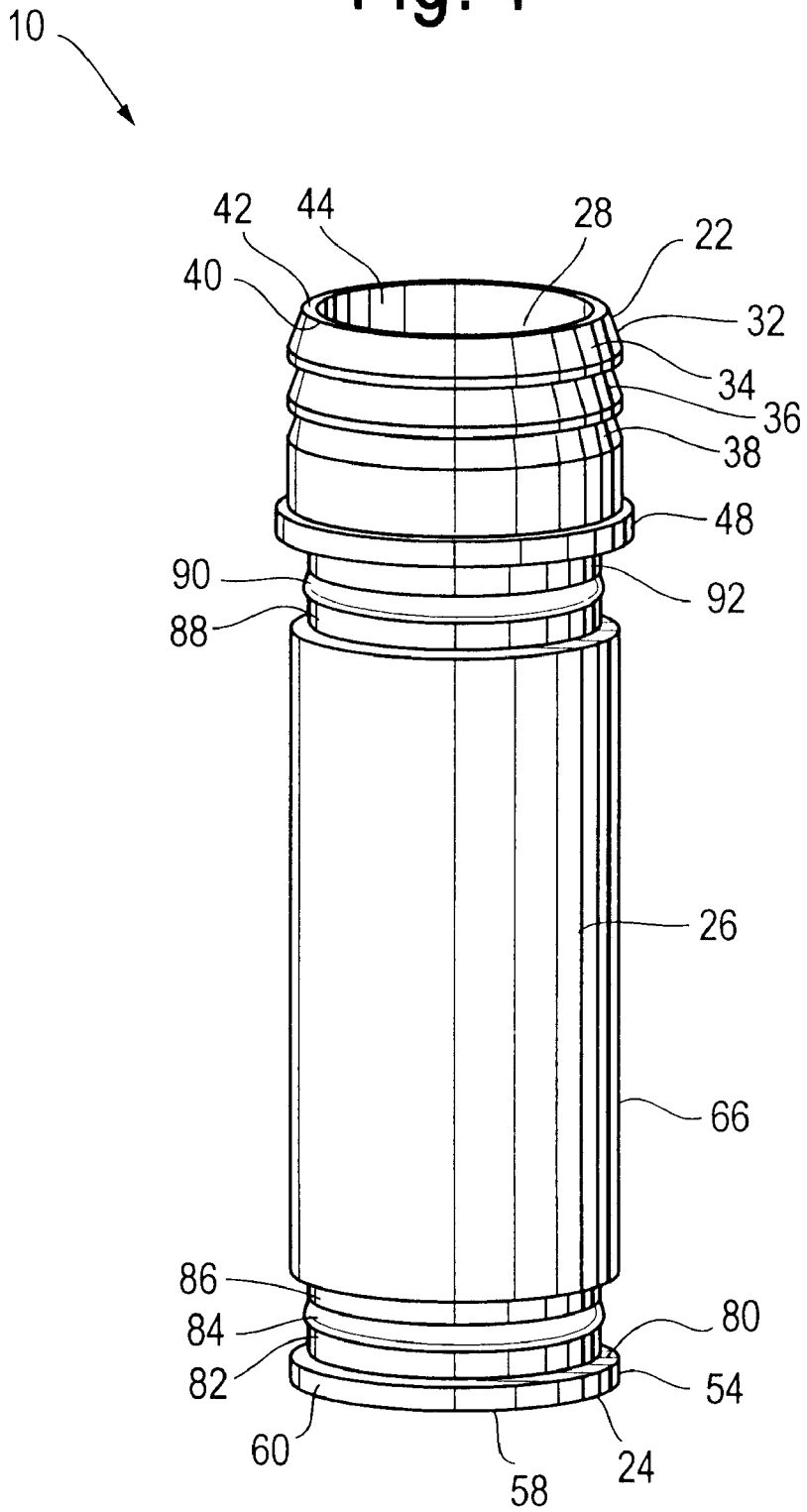
FIG. 1 is a perspective view of a sprinkler nozzle bearing assembly according to one embodiment of the present invention.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Figure 2:
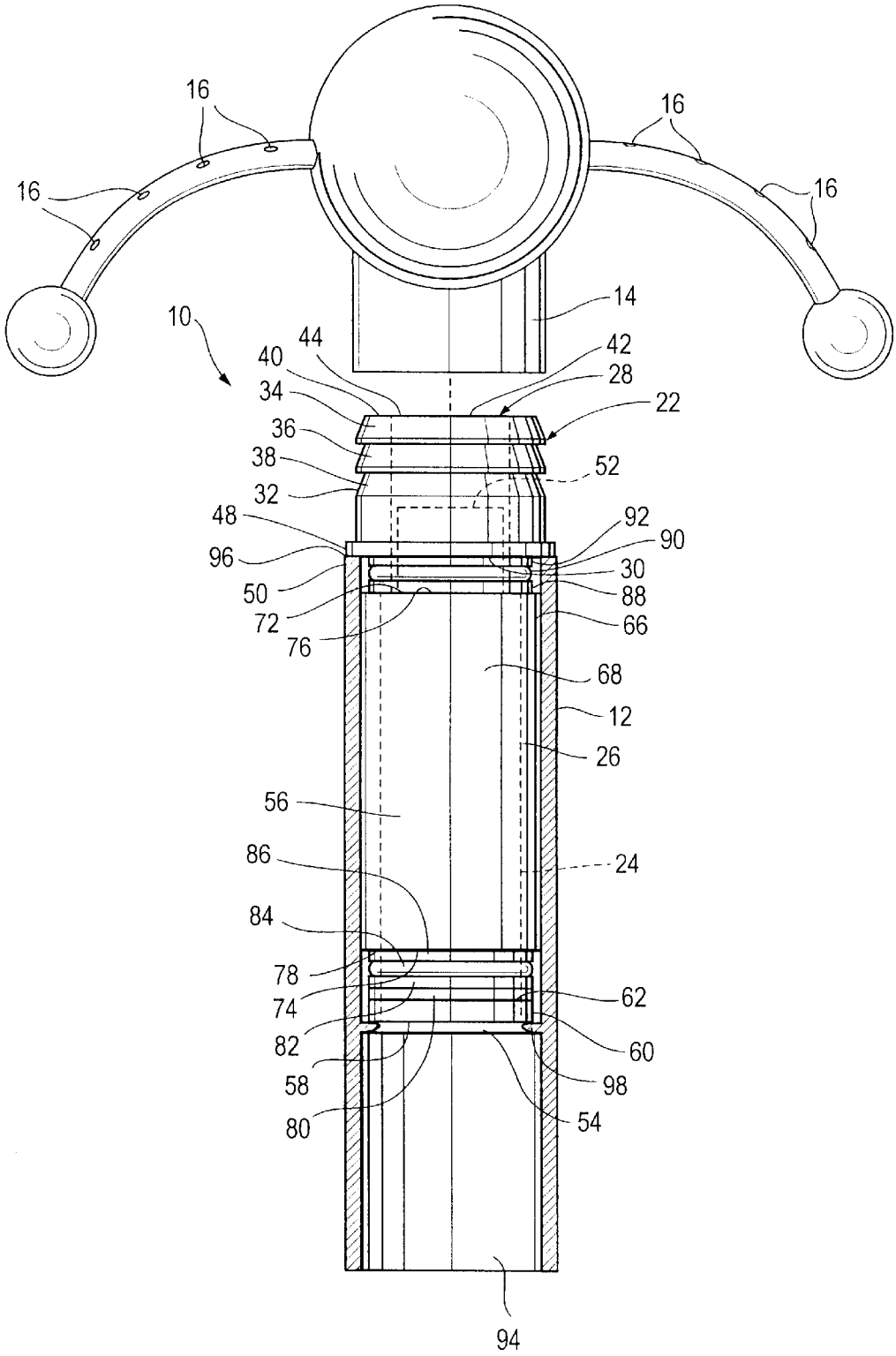
FIG. 2 is a cutaway view of the rotating bearing assembly of FIG. 1 mounted on a pipe with a sprinkler head.
Figure 3:
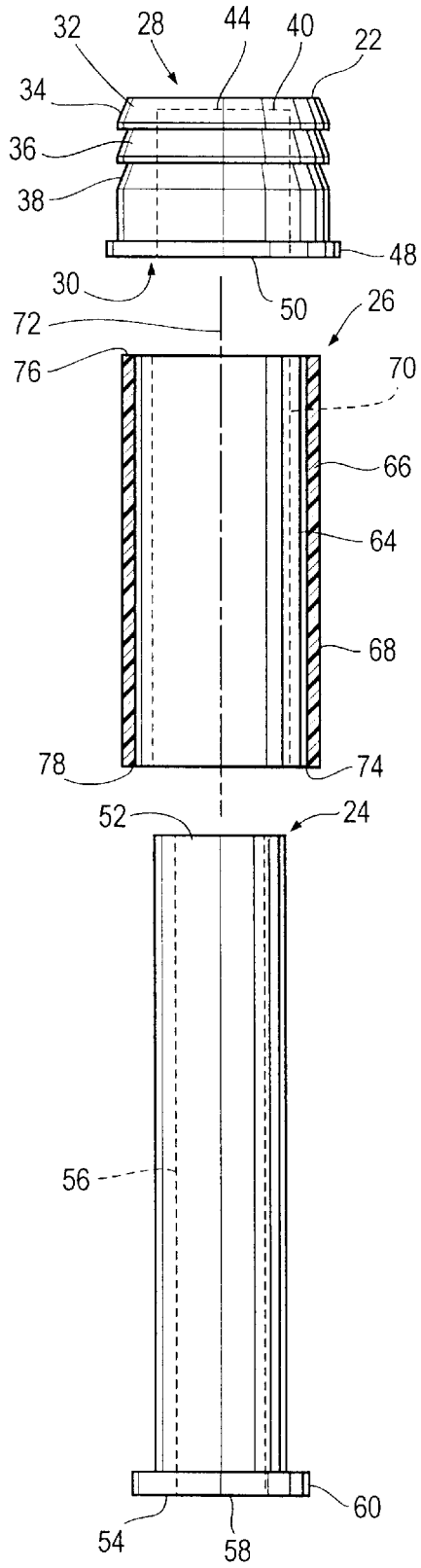
FIG. 3 is an exploded view of the major parts of the bearing assembly of FIG. 1

Referring now more particularly to FIGS. 1–3 of the drawings, there is shown therein a sprinkler bearing assembly generally indicated at 10, which is an embodiment of the present invention. The bearing assembly 10 provides a fluid connection between a pipe segment 12 and a sprinkler head 14. The pipe segment 12 provides pressurized water to the sprinkler head 14. The sprinkler head 14 has a pair of arms which are fluid conduits and rotate when under pressure by the water. The arms have a series of outlets 16 which spray the pressurized water in a predetermined pattern. The rotation of the sprinkler head 14 thus provides irrigation in a circular area with a specific radius determined by the level of pressure of the water. Of course other types of sprinkler heads may be used with different patterns and the flow may be adjusted.

The bearing assembly 10 has a barbed cap 22 which is attached to a stem 24. The cap 22 and the stem 24 are preferably turned from brass. However any suitable resilient material such as copper, steel or plastic may be used. The cap 22 and the stem 24 rotate relative to an annular sleeve 26.

The cap 22 is roughly cylindrical in shape and has an open top end 28 and an open bottom end 30. The top end 28 has an exterior surface 32 with a series of annular barbs 34, 36 and 38. The barbs 34, 36 and 38 form a male connector 40 which may be joined to the sprinkler head 14 to create a water tight seal by pressing the barbs 34, 36 and 38 into the sprinkler head 14. Of course other methods may be used to join the sprinkler head 14 to the male connector 40. The top end 28 has a cylindrical lid 42. An aperture 44 extends through the cylindrical lid 42 to allow water flow to the sprinkler head 14. The open bottom end 30 has an annular collar 48 which has a larger diameter than that of the pipe 12. The open bottom end 30 also has a circular opening 50 which has a diameter sufficient to insert the stem 24.

The stem 24 has an open top end 52 and an open bottom end 54. The top end 52 forms the end of a conduit 56 which provides water flow through the stem 24 to the sprinkler head 14. The bottom end 54 has an opening 58 which allows the flow of water to the conduit 56. The bottom end 54 also has an annular collar 60 which forms an annular shoulder 62. The annular collar 60 has a diameter less than that of the pipe 12. The top end 52 is inserted in the open bottom end 30 of the cap 22. The stem 24 is joined to the cap 22 by a friction fit although other means such as welding or threading may be used.

The cylindrical sleeve 26 has an interior lining 64 and an exterior tube 66. The interior lining 64 is ultra-high molecular weight polyethylene but other materials such as teflon or lubricant filled polymers may be used. The exterior tube 66 is preferably brass or copper but other metals may be used. The exterior tube 66 is optional but provides additional support and can assist in pressing the cylindrical sleeve 26 into the pipe segment 12. The exterior contact layer 66 forms an exterior surface 68 and the inner tube forms an interior surface 70. The diameter of the interior surface 70 is larger than that of the conduit 56 of the stem 24 and is sufficient to allow free rotation of the sleeve 26 around the conduit 56. The cylindrical sleeve 26 has a top end 72 and a bottom end 74. The top end 72 forms a shoulder rim 76 while the bottom end 74 forms a shoulder rim 78.

A series of four washers 80, 82, 84 and 86 are inserted over the conduit 56 and rest on top of each other. The washer 80 rests on the shoulder 62 which is formed from the annular collar 60 of the stem 24. The washers 80, 82 and 86 are Teflon while the washer 84 is an elastomeric material in this example for a fluid seal. The washers 80, 82, 84 and 86 form a high pressure seal as will be explained below. It is to be understood that there may be different numbers of washers to provide additional sealing or reduce wear due to friction. Also, other materials such as rubber, plastic or metal may be used for the washer. The shoulder rim 78 the sleeve 26 rests on the washer 82

A series of three washers 88, 90 and 92 are inserted over the conduit 56 and on top of the sleeve 26. The bottom washer 88 rests on the shoulder rim 76 of the top end 72 of the sleeve 26. The other washers 90 and 92 are stacked on the bottom washer 88. The cap 22 is then inserted over the conduit 56 and is held in place by friction fit. The annular collar 48 of the cap 22 thus locks the sleeve 26 in place but allows the cap 22 and the stem 24 to rotate relative to the sleeve 26. In this example, the washers 88 and 92 are Teflon and the washer 90 is elastomeric. Of course other types and numbers of washers may be used.

The assembly of the bearing system 10 is mated to the pipe segment 12 which may then be attached to a larger structure such as a sprinkler outlet pipe. The pipe segment 12 has an inlet end 94 and an outlet end 96. The sleeve 26 is first inserted in the pipe segment 12. The exterior surface 68 creates a friction fit with the interior walls of the pipe segment 12 thus fixing the sleeve 26 in place in relation to the pipe segment 12. The washers 80–86 are slipped on the stem 24 to rest on the shoulder 62. The stem 24 is then inserted through the inlet end 94 through the sleeve 26 until the washer 86 abuts the shoulder rim 74 of the sleeve 26. A mandril 98 is then inserted through the inlet end 94 of the pipe segment 12 to hold the stem 24 in place.

In general, the sleeve 26 is flush with the outlet end 96 of the pipe segment 12. The stem 24 extends through the outlet end 96. The outlet end 96 of the pipe segment 12 may be crimped in order to hold the sleeve 26 better. The remaining washers 88, 90 and 92 are then slipped on the stem 24. The cap 22 is then attached to the stem 24. The assembly 10 may be connected to a pipe and a sprinkler head as noted above. The sprinkler head 14 is free to rotate since it is attached to the stem 24 and cap 22 which may be rotated relative to the sleeve 26.

The groups of washers 80–86 and 88–92 provide a high and low pressure seal for the bearing assembly 10 respectively. At low water pressure, the weight of the cap 22 pushes the stem 24 downward. The elastomeric washer 90 provides the water seal and the two teflon washers 88 and 92 provide a reduced friction surface between the cap 22 and the sleeve 26 during the rotation of the cap 22. Under higher water pressure in the pipe segment 12, the shoulder 62 of the stem 24 is forced against the sleeve 26. The elastomeric washer 84 creates a seal to prevent leaking between the pipe segment 12 and the sleeve 26. The teflon washers 80 and 86 provide reduced friction surfaces for rotation of the stem 24 relative to the sleeve 26. At very high pressure, the teflon washer 80 rotates with the stem 24 which creates a reduced friction contact with the teflon washer 82.

Figure 4:
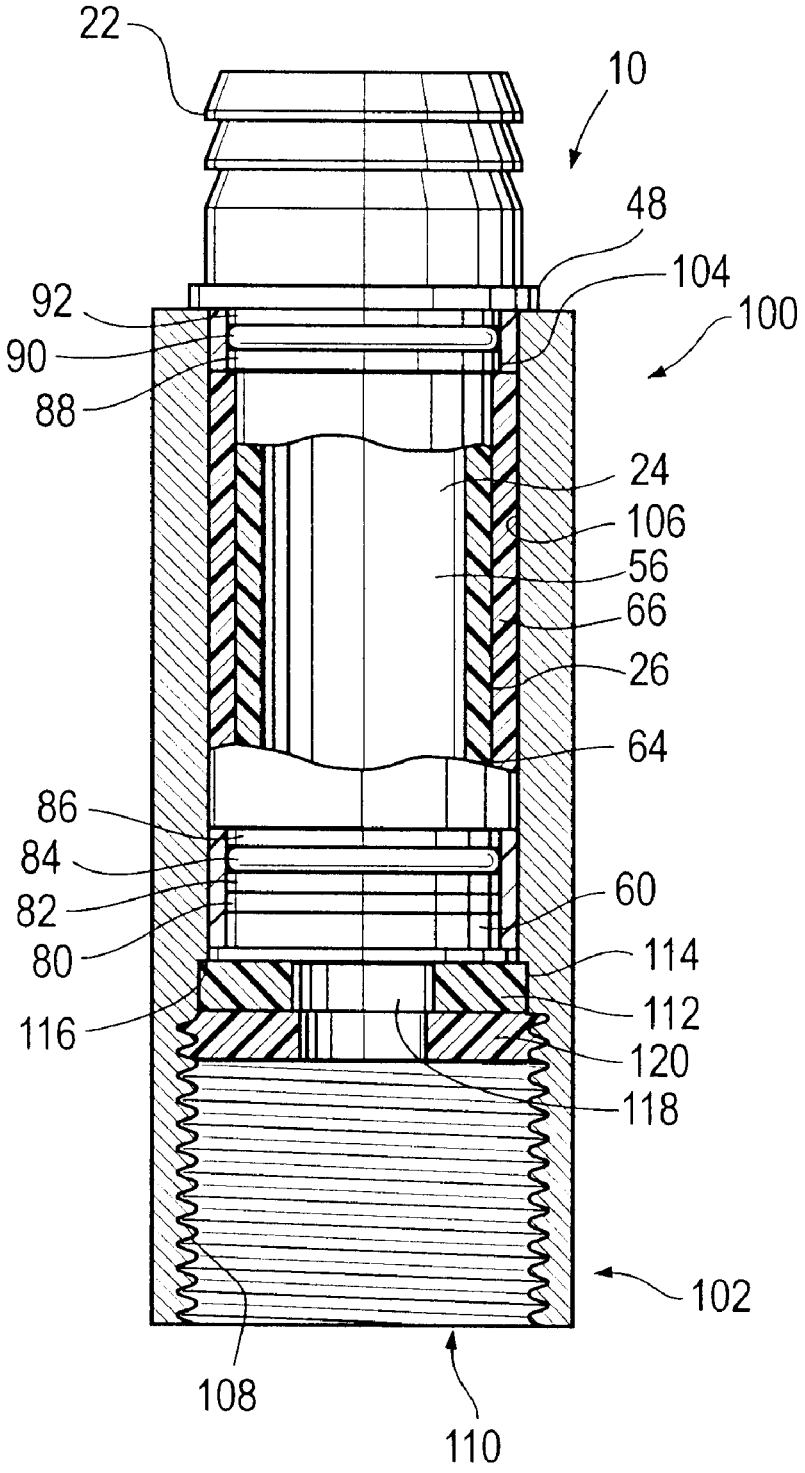
FIG. 4 is a cutaway view of the rotating bearing assembly of FIG. 1 on an alternative mounting arrangement.

FIG. 4 shows an alternative mounting arrangement for the bearing assembly 10 shown in FIGS. 1–3. Identical elements are labeled by the same element numbers as in FIGS. 1–3. The bearing assembly 10 is mated to a pipe socket 100. The pipe socket 100 is generally cylindrical in shape to allow the flow of water to the bearing assembly 10 and has an inlet end 102 and an outlet end 104. The pipe socket 100 is made of brass in this example, but other water resistant and resilient materials such as copper, steel or plastic may be used.

The pipe socket 100 has an upper interior surface 106 which holds the sleeve 26 by friction fit. As in the previous example, the stem 24 and the cap 22 are coupled together and rotate relative to the sleeve 26. A high and low pressure seal is created by the washers 80–86 and 88–92 respectively. The inlet end 102 has a threaded interior surface 108 which forms a female connector 110. This allows the pipe socket 100 to be installed on a male connector for a water conduit. The inlet end 102 has a cap 112 which provides a stop for an inserted male connector. The cap 112 has a collar 114 which is seated on an annular shoulder 116 formed on the upper interior surface 106. The cap 112 is also brass in this example. The cap 112 has a hole 118 therethrough which allows water to flow to the conduit 56. A contact surface for the male connector to the cap 112 is created by a rubber washer 120 which is mounted within the threaded interior surface 108 immediately behind the cap 112.

Figure 5A:
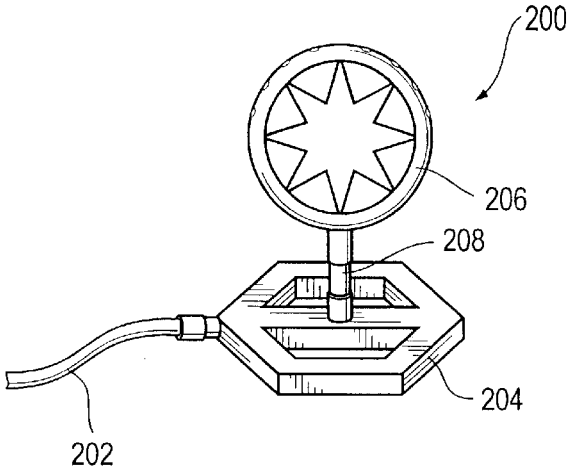
FIGS. 5A–5C are perspective views of various sprinklers which use the bearing assembly in FIG. 1.

The bearing assembly 10 in FIGS. 1–3 may be used in a variety of applications from underground, permanent sprinkler systems to portable or implantable sprinklers. FIG. 5A shows a portable rotating sprinkler 200 which may be connected to a hose 202. The sprinkler 200 has a base 204 which allows it to be placed at a desired location on a lawn. The sprinkler 200 has a rotating spray head 206 which rotates under water pressure and distributes the pressurized water in a spray pattern. The rotating spray head 206 is joined to an internal pipe segment (not shown) via a bearing assembly 208 which is similar to the bearing assembly 10 in FIGS. 1–3.

Figure 5B:
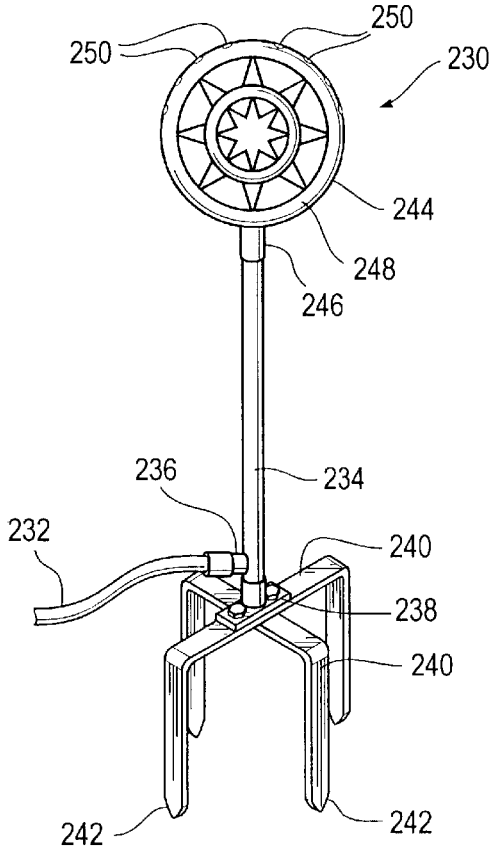

FIG. 5B shows an implantable sprinkler 230 which is connectable to a hose 232. The sprinkler 230 has a support pipe 234 which is supplied with water via a hose connector 236. The pipe 234 is joined by a base member 238 which has a series of arms 240 with spikes 242 at their bottom ends. The base member 238 may thus be inserted into the ground to seat the sprinkler 230. The top of the support pipe 234 is coupled to a rotating sprinkler head 244 via a bearing assembly 246 which is identical to the bearing assembly 10 in FIGS. 1–3. The rotating sprinkler head 244 has a circular pipe 248 with a number of water outlets 250 which spray pressurized water causing the head 244 to rotate.

Figure 5C:
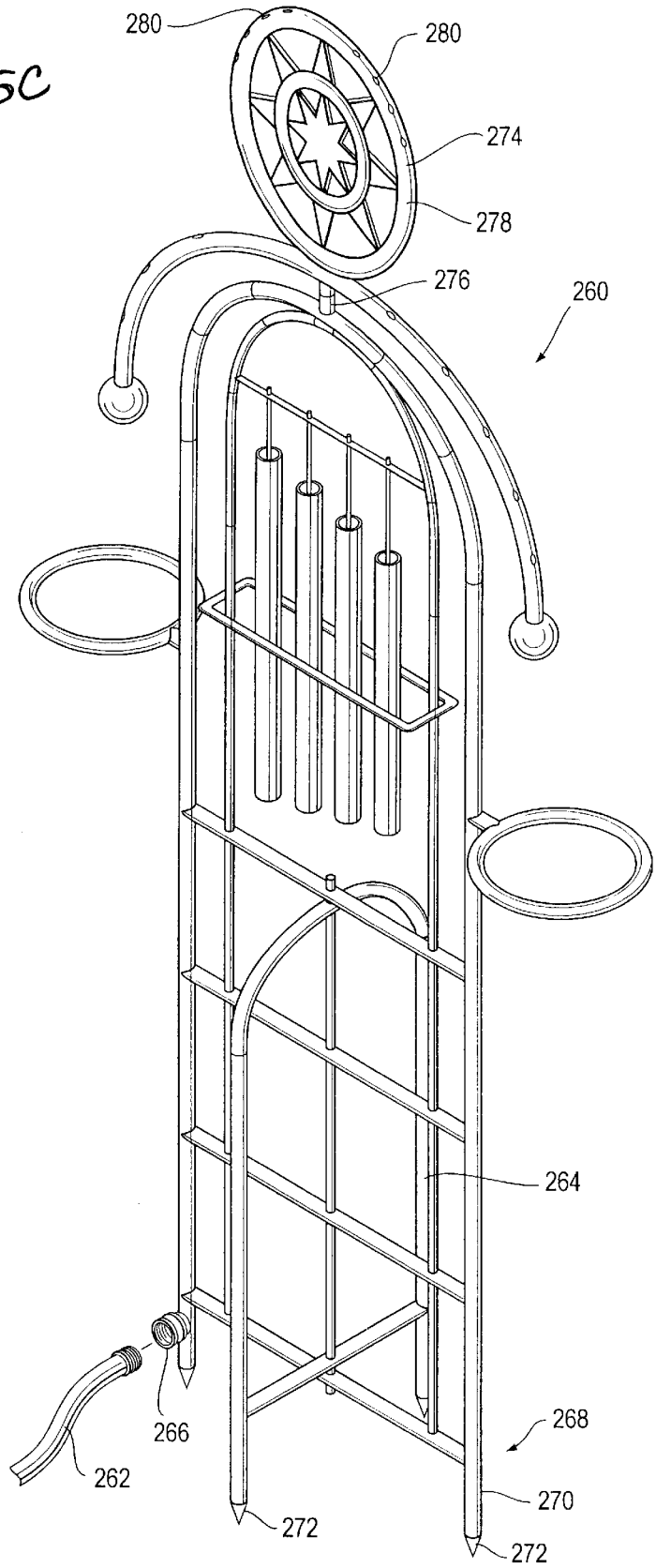

FIG. 5C shows a trellis type sprinkler 260 which is connectable to a hose 262. The sprinkler 260 has a trellis support pipe framework 264 which is supplied with water via a hose connector 266. The pipe framework 264 is joined to a base member 268 which has a series of support members 270 with spiked shaped bottom ends 272. The base member 268 may thus be inserted into the ground to seat the sprinkler 260. The top of the support framework 264 is coupled to a rotating sprinkler head 274 via a bearing assembly 276 which is identical to the bearing assembly 10 in FIGS. 1–4. The rotating sprinkler head 274 has a circular pipe 278 with a number of water outlets 280 which spray pressurized water causing the head 274 to rotate.

It will be apparent to those skilled in the art that various modifications and variations can be made in the method and system of the present invention without departing from the spirit or scope of the invention. For example, any application which requires a rotating bearing providing fluid connection from a pipe segment may use the bearing. Thus, the present invention is not limited by the foregoing descriptions but is intended to cover all modifications and variations that come within the scope of the spirit of the invention and the claims that follow.

What is claimed is:

1. A bearing assembly for rotatably supporting a fluidly connected outlet member from a pipe segment, the bearing assembly comprising:

a hollow, generally cylindrical stem extending along a longitudinal axis and defining a fluid conduit chamber therein, the stem having an inlet end with an annular collar and an outlet end;

a cap connected to the outlet end, the cap having an fluid inlet and an outlet with a connector connectable to the outlet member; and a cylindrical sleeve having an open top end and a bottom end annularly located around the fluid conduit, the sleeve having a uniform outer diameter in fictional contact with the interior of the pipe segment, wherein the cap and the stem rotate relative to the sleeve, and wherein the annular collar has an outer diameter which is less than the outer diameter of the sleeve.

2. The bearing assembly of claim 1 further comprising:

a washer annularly located between the bottom of the sleeve and the collar of the stem; and a second washer annularly located between the top of the sleeve and the cap.

3. The bearing assembly of claim 2 wherein the first and second washers are Teflon.

4. The bearing assembly of claim 2 wherein the first and second washers are elastomeric.

5. The bearing assembly of claim 1 wherein the stem and the cap are brass.

6. The bearing assembly of claim 1 wherein the stem and the cap are copper.

7. The bearing assembly of claim 1 wherein the cap is a generally cylindrical shape having a top end with at least one barb and a bottom end with an annular collar.

8. The bearing assembly of claim 1 wherein the sleeve has an interior lining and an exterior tube.

9. The bearing assembly of claim 8 wherein the interior lining is ultra-high molecular weight polyethylene and the exterior tube is copper.

10. The bearing assembly of claim 1 wherein the outlet member is a sprinkler head.

11. A Searing assembly for rotatably coupling a Sprinkler head to a pipe segment the bearing assembly comprising:

a hollow, generally cylindrical stem extending along a longitudinal axis and defining a fluid conduit chamber therein, the stem having an inlet end with an annular collar and an outlet end;

a cap connected to the outlet end, the cap having an fluid inlet and an outlet with a connector connectable to the sprinkler head;

a cylindrical sleeve having an open top end and a bottom end annularly located around the fluid conduit, the sleeve having a uniform outer diameter in frictional contact with the interior of the pipe segment, wherein the cap and the stem rotate relative to the sleeve, and wherein the annular collar of the stem has an outer diameter that is less than that of the cylindrical sleeve;

a low pressure sealing washer seated around the stem between the top of the sleeve and the cap; and a high pressure sealing washer seated around the stem between the bottom of the sleeve and the collar of the stem.

12. The bearing assembly of claim 11 further comprising:

a low friction washer on the low pressure sealing washer in contact with the cap;

a second low friction washer below the low pressure sealing washer in contact with the top of the sleeve;

a third low friction washer located on the high pressure sealing washer in contact with the bottom of the sleeve; and a fourth low friction washer located under the pressure sealing washer in contact with the collar of the stem.

13. The bearing assembly of claim 12 wherein the low friction washers are Teflon.

14. The bearing assembly of claim 11 wherein the high and low pressure sealing washers are elastomeric.

15. The bearing assembly of claim 11 wherein the stem and the cap are brass.

16. The bearing assembly of claim 11 wherein the stem and the cap are copper.

17. The bearing assembly of claim 11 wherein the cap is a generally cylindrical shape having a top end with at least one barb and a bottom end with an annular collar.

18. The bearing assembly of claim 11 wherein the sleeve has an interior lining and an exterior tube.

19. The bearing assembly of claim 18 wherein the interior lining is ultra-high molcular weight polyethylene and the exterior tube is copper.

* * * * *